US005305905A

United States Patent [19]

Zizinia

[11] Patent Number: 5,305,905

[45] Date of Patent: Apr. 26, 1994

[54] VAPOR TIGHT FLOATING ROOF SUPPORT LEG FOR LIQUID STORAGE TANK

[75] Inventor: Andrew A. Zizinia, Houston, Tex.

[73] Assignee: Amerada Hess Corporation, Galena Park, Tex.

[21] Appl. No.: 27,897

[22] Filed: Mar. 8, 1993

[51] Int. Cl.[5] ..... B65D 88/40

[52] U.S. Cl. ..... 220/220

[58] Field of Search ..... 220/220, 224, 216, 227

[56] References Cited

U.S. PATENT DOCUMENTS

| | | | |
|---|---|---|---|
| 3,587,911 | 6/1971 | Creith | 220/26 |
| 3,915,332 | 10/1975 | Pladys | 220/220 |
| 4,018,356 | 4/1977 | Szasz et al. | 220/220 |
| 4,243,151 | 1/1981 | Bruening | 220/216 |
| 4,244,487 | 1/1981 | Kern | 220/216 |
| 5,230,436 | 7/1993 | Vaughn | 220/220 |

*Primary Examiner*—Joseph Man-Fu Moy

*Attorney, Agent, or Firm*—Vinson & Elkins

[57] ABSTRACT

The disclosure herein describes a vapor tight floating roof support leg for a liquid storage tank characterized by a leg and a seal at the top of the leg so as to prevent the escape of fugitive volatile organic or other gaseous compounds from evaporation from the surface of the liquid. In one embodiment, the leg is of one fixed length and the seal is comprised of a blind welded, bolted or otherwise firmly affixed to the top of the leg. In another embodiment wherein the support leg is comprised of two pieces, an inner pipe leg slides into a hollow sleeve. The seal at the top of the support leg is comprised of a flange firmly attached to the sleeve, and a blind is welded, bolted or otherwise firmly affixed to an inner leg which may be any predetermined length. The blind is firmly attached to the flange.

5 Claims, 1 Drawing Sheet

VAPOR TIGHT FLOATING ROOF SUPPORT LEG FOR LIQUID STORAGE TANK

BACKGROUND OF THE INVENTION

This invention relates to a sealed support leg mounted to a floating roof of a large liquid storage tank. The support leg keeps the roof from traveling downward beyond a certain point while preventing any volatile organic or other gaseous compounds ("VOC's") from escaping upwards from the surface of the liquid through roof penetrations where the support leg is mounted. Without a sealed support leg, the VOC's would disperse in the atmosphere as air pollution. Stringent governmental regulations make it imperative that any loss of VOC's be minimized.

Large, usually round liquid storage tanks may contain a floating internal roof to minimize the loss of liquid products, typically hydrocarbons. These roofs float directly on the liquid surface, and rise or fall with changes in the level of liquid in the tank. Some floating roofs have legs mounted thereon to prevent downward travel of the roof beyond a certain point once the bottom of the leg comes to rest on the floor of the storage tank. These legs typically extend through the floating roof to keep the roof from hitting the bottom of the tank or traveling beyond a certain point when the liquid is withdrawn. Many such legs are slidably adjustable in a substantially vertical plane at right angles to the roof to change the point at which the downward travel of the roof is stopped. However, a continuing problem with floating roof support legs is the inability of such legs to stop or reduce VOC emissions from escaping through or around the top of the leg and thus polluting the atmosphere.

The conventional floating roof support leg comprises an inner support member such as a rod or pipe, and an outer sleeve which is greater in diameter than the inner member. The leg commonly projects through the roof for a certain distance. The height of the leg is adjustable by means of the inner member inserted or slidably mounted into the larger diameter sleeve. Both the sleeve and inner member have a series of holes spaced throughout their length such that a throughbolt can be inserted through the sleeve and member to secure the inner member at a certain fixed length.

The position of the inner pipe relative to the enclosing sleeve results in the accumulation of VOC's in the annular space between the inner pipe and the sleeve above the liquid level in the tank. These VOC's then escape up through such annular space into the atmosphere. Believed exemplary of such conventional support legs are U.S. Pat. Nos. 3,587,911 (Creith), 3,915,332 (Pladys), and 4,018,356 (Szasz). These patents disclose support legs which are not designed to solve the problem of VOC emissions from the tops of such legs.

U.S. Pat. No. 4,243,151 (Bruening) addresses the general problem of VOC emissions resulting from penetrations in floating roofs. The Bruening patent discloses a stationary vertical member, such as a support column or a ladder, penetrating the floating roof of a liquid storage tank. The stationary vertical member extends up through a well, which in turn is surrounded and partially enclosed by a well wall. The well wall is partially above and below the level of liquid stored in the tank, and is separated from the vertical member by a vapor seal. The well wall physically prevents liquid from spilling through the area surrounding the vertical penetration, and the vapor seal within the well wall reduces the space in which vapor from the liquid can first accumulate and then be dispersed into the atmosphere.

SUMMARY OF THE INVENTION

This invention relates to a support leg for a floating roof of a large storage tank. Such tanks are typically round and contain liquid hydrocarbon fluids. Surface evaporation of the hydrocarbon liquid in turn produces VOC's which can escape through the top of conventional support legs into the atmosphere to cause air pollution.

The invention provides a novel construction for support legs for floating roofs of large liquid storage tanks which overcome the problem of VOC emissions by completely sealing against the escape of such emissions within the support legs, whether the support leg structure is of fixed or adjustable length. Specifically, the invention comprises a seal firmly affixed to the top of the leg which prevents VOC's from escaping from the top of the leg into the atmosphere.

The Application discloses two preferred embodiments of the claimed invention. In the first embodiment, the leg is comprised of a hollow pipe or sleeve of predetermined length to keep the roof at a predetermined distance from the floor of the tank. The top of the sleeve is sealed so as to prevent the escape of VOC's.

In the second embodiment, the adjustment of the roof leg to a predetermined length is accomplished through the use of different lengths of pipe onto one end of which a blind flange is welded, bolted or otherwise firmly affixed. The pipe with the blind flange in turn slides into a hollow sleeve which has a flange sealed, bolted or otherwise firmly affixed to its top. The blind is then firmly attached to the flange on top of the hollow sleeve so as to prevent the escape of VOC's from the annular space between the pipe and the hollow sleeve. When a different leg length is desired, the blind and flange can be disengaged, the inner pipe removed, and another pipe of different length having a blind firmly affixed to one end is in turn inserted into the hollow sleeve. The use of different inner pipe lengths with a blind flange eliminates the need to have a throughbolt arrangement for adjustment of the support leg as well as eliminates potential avenues of hydrocarbon escape.

Accordingly, it is an object of this invention to provide a floating roof support leg which will prevent the escape of VOC's from the surface of the liquid, typically hydrocarbons, into the atmosphere as pollution.

BRIEF DESCRIPTION OF THE DRAWINGS

These and other objects and advantages of the present invention will be apparent from the following disclosure and description thereof. In the accompanying drawings, in which like numerals indicate like parts.

DETAILED DESCRIPTION OF THE PREFERRED EMBODIMENT

Figure 2:
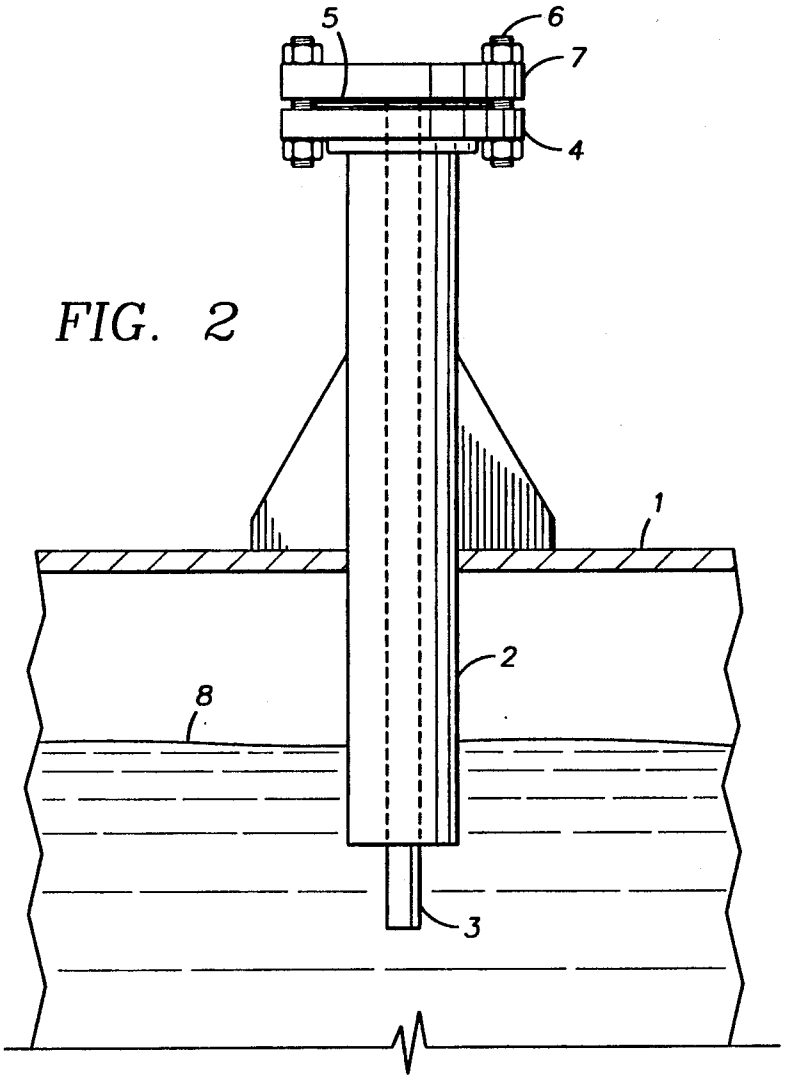
FIG. 2 is a side elevational view illustrating a second embodiment of the invention where the leg is comprised of inner and outer leg constructions.

Throughout the following descriptions similar reference numerals refer to similar elements in all figures of the drawings.

Figure 1:
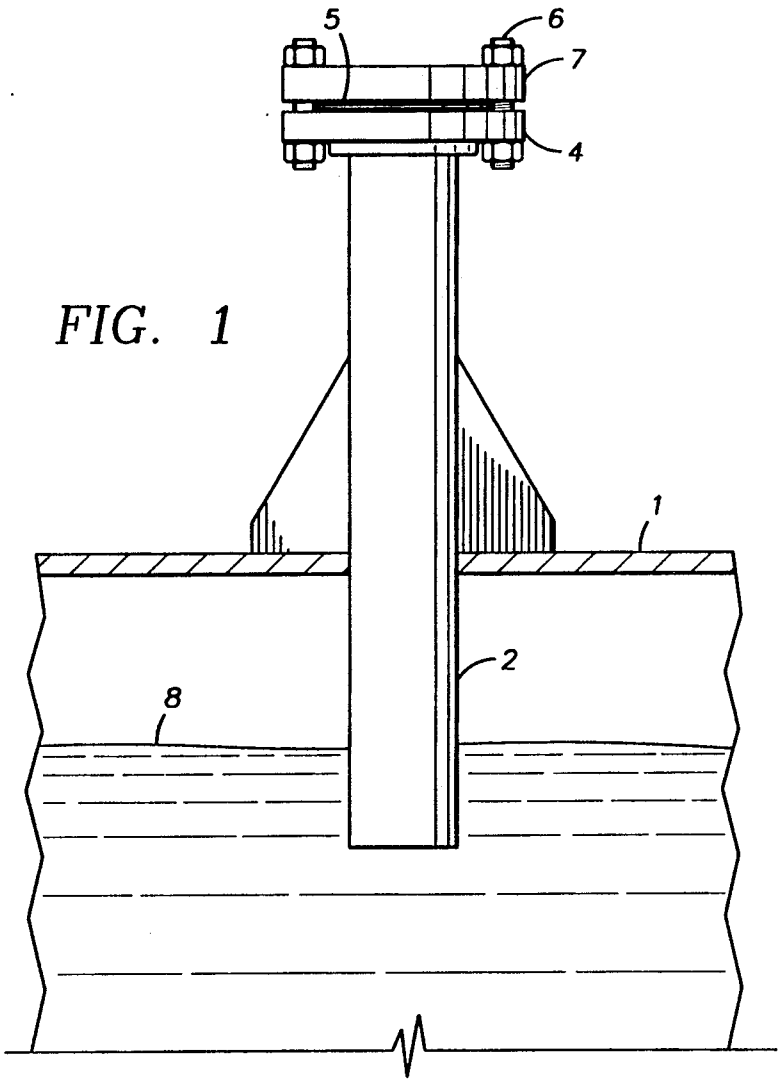
FIG. 1 is a side elevational view illustrating one embodiment of the invention comprising a leg of fixed length.

FIGS. 1 and 2 show side elevational views of two embodiments of the vapor tight floating roof support leg for a liquid storage tank embodying the teachings of this invention. Although not shown in these drawings, the floating roof 1 is usually circular in plan view to fit the generally circular liquid storage tanks. The presence of the roof 1 reduces but does not eliminate the loss of hydrocarbon liquid through evaporation into the atmosphere. The floating roof 1 is supported at a certain predetermined distance above the base of the tank by one or more of the floating roof support legs when the liquid level is low; otherwise the roof floats directly on the surface of the liquid. FIGS. 1 and 2 illustrate only two such leg supports. However, the floating roof may utilize many leg supports.

Referring to FIG. 1, leg sleeve 2 is hollow, of fixed length and made of conventional pipe material. Leg sleeve 2 is welded or bolted to floating roof 1 by conventional means. Leg sleeve 2 allows fugitive VOC's to accumulate within it from surface evaporation of the liquid surface 8. Sealing the top of the leg sleeve 2 is blind 7. Blind 7 is directly bolted to flange 4 on top of leg sleeve 2. Blind 7 and flange 4 are bolted together using throughbolts 6 with a rubber or other conventional gasket 5 between blind 7 and flange 4 in such a way as to form a vapor seal, effectively stopping the escape of VOC's.

Referring to FIG. 2, inner support leg 3 is also made of conventional pipe material and is fitted and positioned within leg sleeve 2, so that inner support leg 3 is slidably moveable in the vertical plane within leg sleeve 2. Leg sleeve 2 may be of any suitable diameter to allow inner support leg 3 to move easily within it. There thus exists an annular space between inner support leg 3 and leg sleeve 2 where VOC's accumulate from surface evaporation of the liquid surface 8.

To completely seal the top of the support leg and thus prevent the escape of VOC's, a flange 4 is welded, bolted or otherwise firmly affixed to the top of leg sleeve 2. A blind 7 is welded, bolted or otherwise firmly affixed to the top of inner support leg 3. Blind 7 is in turn firmly attached to flange 4 by an array of throughbolts 6, after the inner support leg 3 is inserted into leg sleeve 2. In order to effect a tight seal between the flange 4 and blind 7, a rubber or other conventional gasket 5 is interposed between the two pieces, effectively providing a vapor seal of the annular space between inner support leg 3 and the leg sleeve 2.

What is claimed is:

1. A sealed support leg for a floating roof of a liquid storage tank comprising:
   - a hollow sleeve firmly affixed to a floating roof of a liquid storage tank and having an upper and lower extension above and below said roof wherein said lower extension supports the roof at a predetermined distance from the bottom of the tank when the liquid in the tank reaches a certain low level;
   - a flange fitted closely around and firmly attached to said upper extension; and
   - a blind flange securely attached to said flange so as to produce a seal and prevent leakage of fluids or gases into the atmosphere.

2. A sealed support leg as recited in claim 1, wherein said flange and blind are attached to one another by a sealing means disposed circumferentially between said flange and blind.

3. An adjustable sealed support leg for a floating roof of a liquid storage comprising:
   - a hollow sleeve firmly affixed to a floating roof of a liquid storage tank having an upper extension above said roof;
   - a leg having an upper and lower end wherein said lower end supports the roof at a predetermined distance from the bottom of the tank when the liquid in the tank reaches a certain low level, said leg slidably movable and inserted within said hollow sleeve; and
   - said upper extension of said sleeve being firmly attached to said upper end of said leg and said upper extension of said hollow sleeve being sealed so as to prevent leakage of fluids or gases upward through said sleeve into the atmosphere.

4. An adjustable sealed support leg as recited in claim 3, wherein said upper extension seal comprises:
   - a flange fitted closely around and firmly attached to said upper extension; and
   - a blind flange securely attached to said upper end of said leg wherein said blind flange is securely attached to said flange so as to produce a seal and prevent leakage of fluids or gases into the atmosphere.

5. An adjustable sealed support leg as recited in claim 4, wherein the said flange and blind are attached to one another by a sealing means disposed circumferentially between said flange and blind.

* * * * *